United States Patent [19]

Sullivan et al.

[11] 4,257,590

[45] Mar. 24, 1981

[54] PORTABLE HOME GYMNASIUM

[75] Inventors: James L. Sullivan, Brea; David S. Ryan, Capistrano Beach, both of Calif.

[73] Assignee: Javier R. Ruiz, Newport Beach, Calif.

[21] Appl. No.: 827,879

[22] Filed: Aug. 26, 1977

[51] Int. Cl.[3] ..... A63B 21/06

[52] U.S. Cl. ..... 272/117; 272/123; 272/144

[58] Field of Search ..... 272/117, 118, 120, 121, 272/144, 145, 122, 128, 143, 134

[56] References Cited

U.S. PATENT DOCUMENTS

| | | | |
|---|---|---|---|
| 337,942 | 3/1886 | Farley | 272/118 |
| 376,741 | 1/1888 | Howard | 272/118 |
| 426,249 | 4/1890 | Dowd | 272/117 |
| 457,400 | 8/1891 | Dowd | 272/118 |
| 776,824 | 12/1904 | Bryon | 272/118 |
| 857,447 | 6/1907 | Cooper | 272/118 |
| 1,052,962 | 2/1913 | Reach | 272/118 |
| 2,648,540 | 8/1953 | Hunter | 272/118 |
| 4,125,258 | 11/1978 | McArthur | 272/118 |

*Primary Examiner*—William R. Browne

*Attorney, Agent, or Firm*—Herzig & Walsh, Inc.

[57] ABSTRACT

A portable exercising device of simplified design and construction which enables a user to perform a number of different types of exercises. An upright frame or scaffold is provided. A cage or frame for supporting weights is positionable between uprights at the sides of the frame or scaffold. A system of pulleys and lines is provided with detachable hand grips or a bar at the ends of the lines so that a user in various positions holding the hand grips or bar can pull on the lines to raise and lower the cage holding the weights. The user may work between the uprights at the sides of the frame to perform uplifting exercises using barbells and the like. The system of pulleys includes pulley blocks and pulleys at the lower part of the frame and pulley blocks and pulleys at the upper part, the lower ones being swivel mounted and the upper ones being hinged. Alternatively, the lines can pass or not pass over the lower pulleys, the device thereby accommodating many different manners or modes of utilization.

2 Claims, 14 Drawing Figures

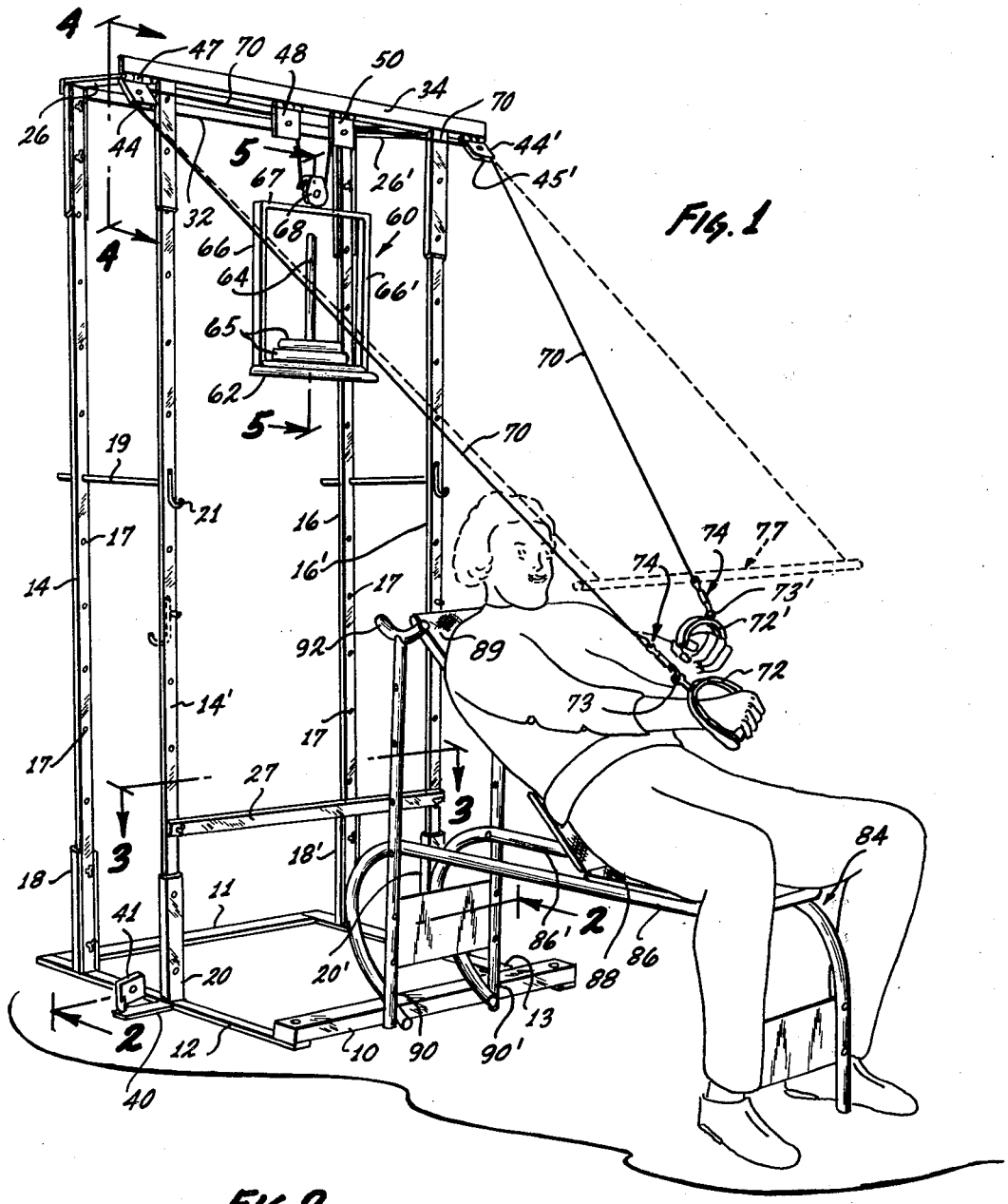
Fig. 1
Fig. 2
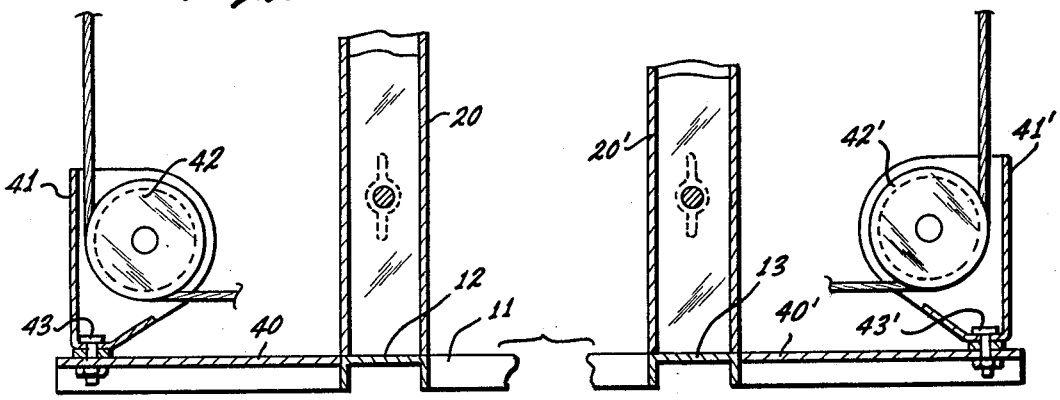

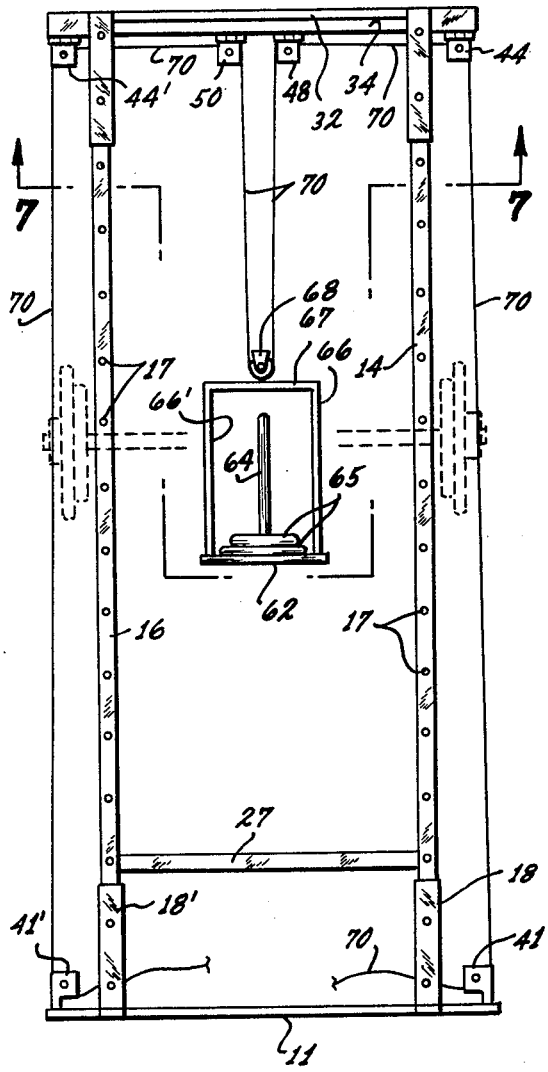
FIG. 6
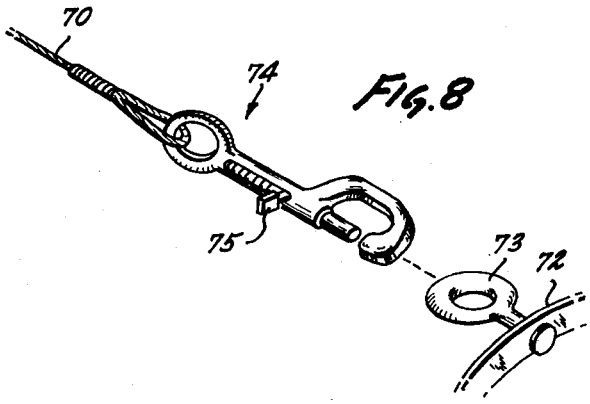
FIG. 8
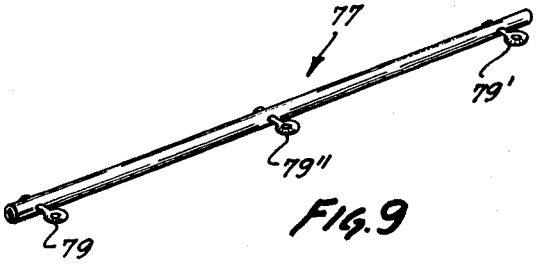
FIG. 9
FIG. 7
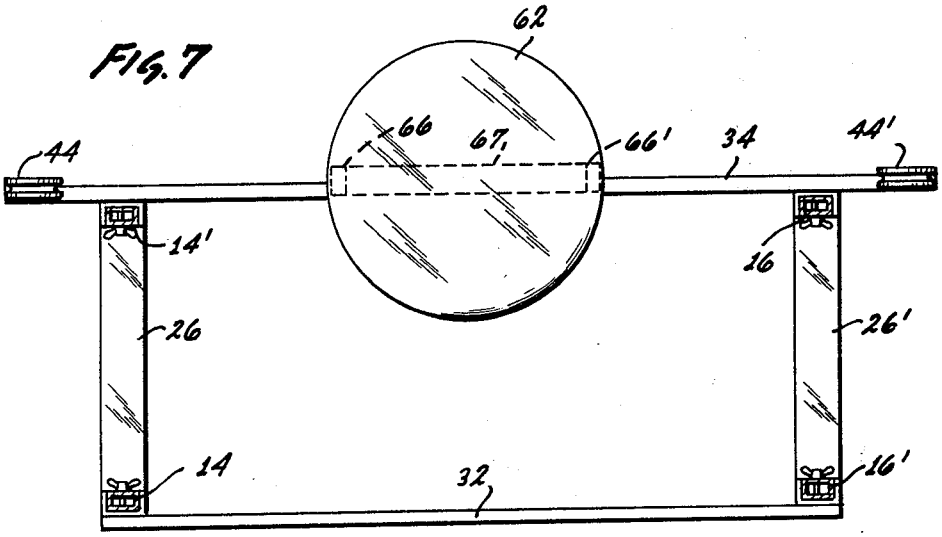

PORTABLE HOME GYMNASIUM

BACKGROUND OF THE INVENTION

1. Field of the Invention

The field of the invention is that of exercising apparatus and/or weight lifting devices. The invention is more particularly concerned with apparatus of this type which is portable and which is adapted for use in the home.

2. Description of the Prior Art

Types of exercising apparatus are shown in prior art patents including U.S. Pat. Nos. 1,646,818; 2,632,645; 2,648,540; 3,614,097; 3,815,903; and 3,874,657. Apparatus that is less related is shown in prior art patents including U.S. Pat. Nos. 3,207,511; 3,346,256; 3,709,167; 3,741,538 and 3,850,431. The types of apparatus in the first group of patents are relatively complex and lack the desired degree of portability. Additionally, in general, these devices or systems are lacking in the desired degree of versatility as respects capability to allow the user to perform desired different types of exercises. Typically, in these known types of apparatus, there are used two sets of weights and their correspondingly duplicate sets of pulleys and line systems whereby the weights are raised and lowered by manipulation of the hands and arms of the user. The herein invention is calculated to overcome these particular deficiencies as outlined, and to provide improvements as outlined in the detailed description hereinafter.

SUMMARY OF THE INVENTION

In a preferred embodiment of the invention as described in detail hereinafter, it takes the form of a portable frame or scaffold. The frame has upright side members upstanding from supporting members that can rest on the floor. At the upper ends of the uprights are transverse members connected between the uprights. A weight-holding cage is provided and is positionable between the side uprights. A system of pulleys and lines is provided. This system includes pulleys mounted at the bottom of the frame structure outside of the uprights and a group of pulleys carried by one of the transverse members at the top. Flexible lines can pass over the bottom pulleys and over the top pulleys carried by the transverse member at the top, and the lines then passing over the pulley on a cage which carries the weights. The user can take a position adjacent to the frame structure to grasp grips at the ends of the lines, and then by manipulation of the lines, the cage carrying the weights can be raised and lowered as desired. With this design and arrangement, only a single weight assembly is required rather than duplicate sets of weights.

The apparatus offers unusual versatility in the manner of its utilization and the different types of exercises that can be performed with it. The ends of the lines can be attached either to hand grips or an elongated bar. The apparatus can be used with the lines passing over only the upper pulleys and then to the pulley on the weight cage or, on the other hand, the lines can be arranged to pass over the pulleys at the bottom of the frame structure. The pulleys at the bottom are in blocks having a swivel mounting and the pulley blocks at the top are hinged. Using the pulleys at the bottom accommodates the apparatus to exercising from positions on or near the floor, the swivel mountings of the blocks accommodating pulls on the lines from various directions depending on the position taken by the user. The hinged mounting of pulley blocks at the top allows them to swing and to accommodate various directions of pull on the lines passing over these pulleys.

The weight carrying cage can be moved away from its position between the side uprights and the user can take a position directly between the uprights as desired for purposes of performing exercises such as weight-lifting, using barbells and the like. A barbell is supportable on moveable hooks and can be supported by way of holes provided in the vertical side uprights.

In the light of the foregoing, the primary object of the invention is to provide an improved, simplified, and portable exercising machine or apparatus adapted for home use.

A further object is to provide apparatus as described, which is of simplified construction, but possesses great versatility from the standpoint of the types of exercises that can be performed with it.

A further object is to provide apparatus as described having a frame with upright side members and having a single cage for holding weights along with a system of pulleys and lines with hand grips or a hand bar at the ends so that the user can manipulate the lines, and raise and lower the single weight-supporting cage.

A further object is to provide apparatus as described having the capability that the weight-supporting cage can be moved from its normal position with the user taking a position between the vertical uprights for purposes of performing other types of exercises.

Further objects and additional advantages of the invention will become apparent from the following detailed description and annexed drawings.

BRIEF DESCRIPTION OF THE DRAWINGS

FIG. 1 is an isometric view of preferred form of the apparatus of the invention illustrating one mode of utilization;

FIGS. 2, 3, 4 and 5 are sectional views taken respectively along the lines 2—2, 3—3, 4—4 and 5—5 of FIG. 1;

FIG. 6 is a rear view of the apparatus of FIG. 1;

FIG. 7 is a sectional view taken along the line 7—7 of FIG. 6;

FIG. 8 is a detail view of a snap-hook type of attachment for attaching cables to hand grips or a hand bar;

FIG. 9 is a detail view of a hand bar with metal eyes for securement of snap hooks;

DESCRIPTION OF THE PREFERRED EMBODIMENT

Figure 3:
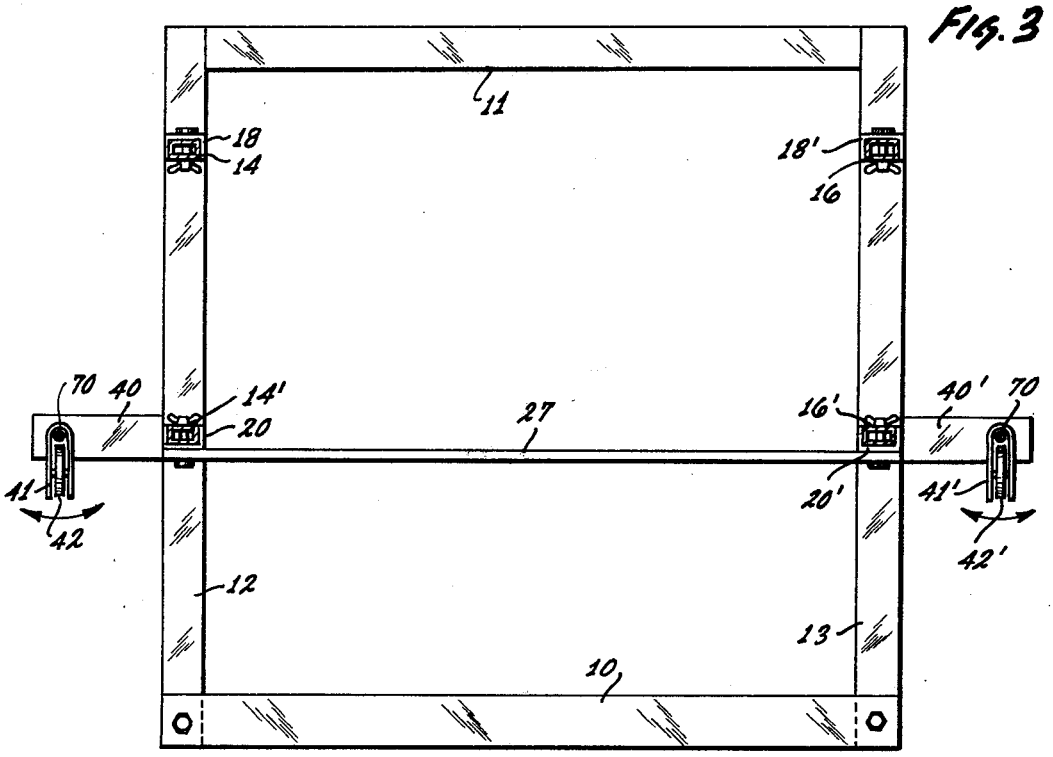

Referring now in more detail to FIGS. 1–7 of the drawings, there is shown an upright frame or scaffold construction supported on a rectangular base formed of front and back members 10 and 11 and side members 12 and 13. The front member 10 is a thicker member and is secured at its ends to the ends of side members 12 and 13 by bolts or other means. The back members 11 can be secured to the side members 12 and 13 by any suitable means. These members may be made of any suitable material. The base may rest on the floor of a home or the like. Upstanding from the base are upright members 14 and 16, each provided with spaced holes as shown at 17 to receive removable bars as shown at 19. Hooks as shown at 21 are provided for supporting barbells or the like. At the lower ends of these members are channel members 18 and 20 which are secured to the uprights and which provide for suitable securement to and support from the base.

Similar uprights and channel members are provided upstanding from the base and these members are identified by corresponding reference numerals primed.

The lower ends of the uprights 14 and 14' are secured to the channel members 18 and 20 by wing nuts as shown to provide for easy disassembly or demountability. Channel members 20 and 20' may be secured to the base member 12 by welding as illustrated in FIG. 2 and the member 12 may be a channel member.

Extending between the upper ends of the upright members 14 and 14' is a brace member 26 and between the upper ends of the uprights 16 and 16' is a similar member 26'. At the upper ends of all of the uprights are similar channel members corresponding to the previously described channel members 18–20 to which the uprights are similarly secured by wind nuts. Numeral 27 designates a removable front brace member extending between members 14' and 16' and secured by wing nuts.

Extending transversely between the side uprights at the top are transverse members. One of these is designted at 32 extending between the uprights 14 and 16. Numeral 34 designates a second transverse member extending between the uprights 14' and 16', this member being longer, its ends extending beyond the uprights 14' and 16' as shown. This member will be referred to again presently.

Extending outwardly laterally from the base member 12 is a short support member 40 which supports pulley block 41 and a pulley 42. Pulley block or housing 41 is secured to the support member 40 by a bolt 43 as shown for swivelling movement. At the opposite side of the frame structure is a similar support member 40', pulley block 41' and pulley 42', the pulley block or housing being secured to the member 40' by a bolt 43'. See FIG. 2.

Supported at the outer end of the upper transverse member 34 is a pulley block 44 and pulley 45 and at the opposite end of the member 34 is a corresponding pulley block 44' supporting pulley 45'. The pulley block 44 and pulley 45 are shown in detail in FIG. 4. Pulley block 44 is attached to the member 34 by a hinge 47 so that it can swing outwardly in a manner illustrated in FIG. 1 and pulley block 44' is similarly mounted by way of a hinge.

Figure 4:
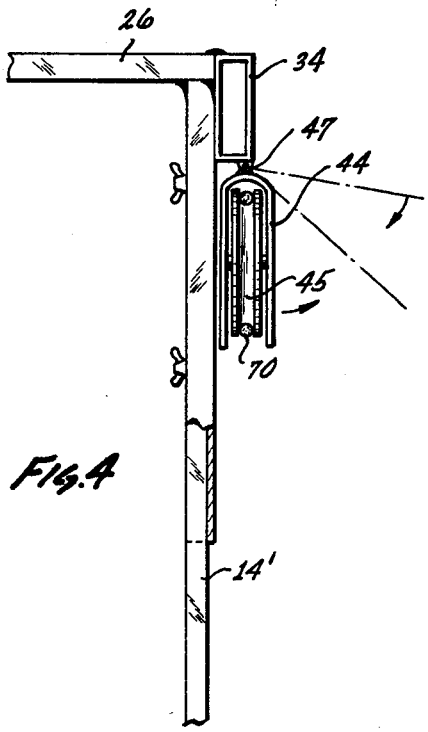
Figure 5:
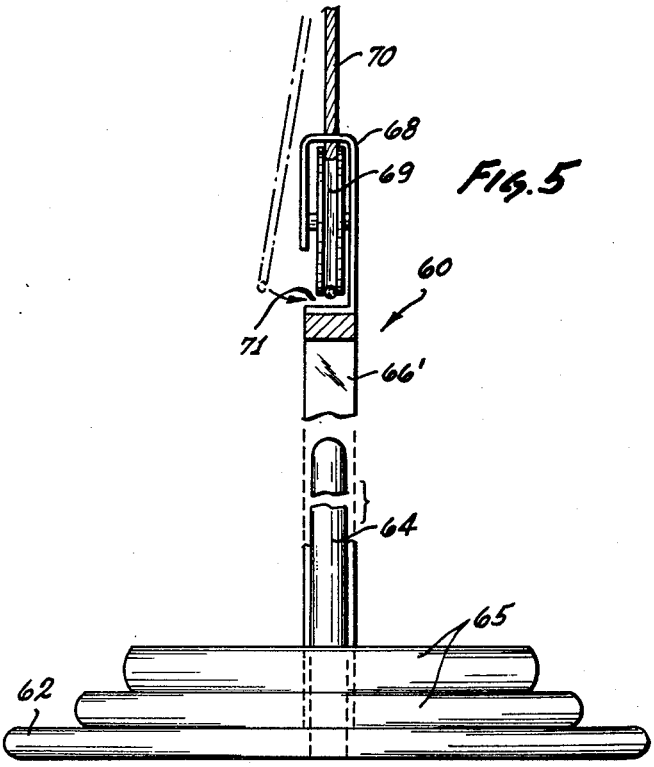

With respect to the pulley blocks 41 and 41', the bolts 43 and 43' provide for a swivel mounting of these blocks as will be described more in detail presently. FIG. 4 is a cross-sectional view which illustrates the mounting of pulley block 44 and pulley 45 from the transverse member 34.

Supported beneath an intermediate part of the member 34 are two similar hinged pulley blocks 48 and 50 having pulleys in them. All of the pulley blocks 44, 44', 48 and 59 are hinged to the member 34.

Numeral 60 designates a cage or frame enclosure for purposes of supporting weights of conventional type as illustrated in FIGS. 1, 5, 6, 10 and 11. Cage 60 has a circular base as designated at 62. It is illustrated in more detail in FIG. 5. It has an upright rod 64 upon which circular weights having a center opening can be mounted as shown at 65. The cage has two upright members 66 and 66' with a transverse member 67 extending between the upright members. The member 67 supports a pulley block 68 supporting a pulley 69. The pulley block 68 is open as may be seen at 71 to allow a cable to be placed over and removed from the pulley. See FIG. 5.

Numeral 70 designates a flexible line, cable or rope that is reeved over the pulleys as illustrated in FIGS. 1–6 and FIGS. 10–11. At the ends of the line are the hand grips 70 and 72' which can be grasped by the user. As may be seen, the line or lines can pass over the pulleys 42 and 42' and can pass over the pulleys in blocks 44 and 44' and 48 and 50 after which the line can pass over the pulley 69 in block 68.

Figure 12:
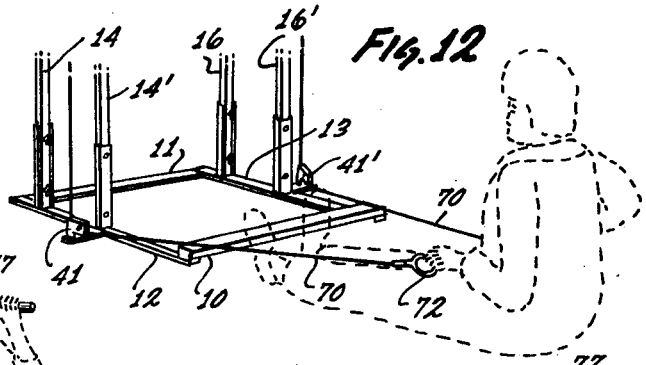
FIG. 12 is a partial view illustrating another form of the invention or manner of utilization thereof.

FIGS. 6 and 12 illustrate an arrangements wherein the line or cable passes over the pulleys in blocks 41 and 41'. The ways in which the apparatus can be utilized will be described in more detail presently.

The hand grips 72 and 72' have eye members 73 and 73', part of the hand grip 72 shown in more detail in FIG. 8 having the eye 73. Preferably, at the ends of the cable 70 there are provided snaps such as shown at 74 in FIG. 8. The snap itself is of conventional construction having a thumb operator 75 and being secured by a loop at the end of the cable 70. The snaps can be engaged with the eyes 73 and 73' or disengaged thereform. As an alternative to the hand grips 72 and 72', a hand bar 77 may be utilized with the cable snapped to eyes at the ends of the hand bar, the eyes being designated at 79 and 79' with an additional eye 79'' at the midpoint of the bar. The use of the bar will be referred to again presently. FIGS. 1–6 represent what is presently considered the best mode of practicing the invention.

One manner of utilization of the apparatus is illustrated in FIG. 1. The user is shown reclining on his back on the rest stand 84 which may be of conventional construction. The rest stand is of tubular construction having parallel tubular horizontal members 86 and 86', the ends of which are curved as shown forming legs. The stand is provided with a seat designated by the numeral 88 and which has a back part 89. The stand has two tubular uprights 90 and 90' which have transverse holes through them, the uprights being secured to a point on the frame members 86 and 86'. At the upper ends of the uprights 90 and 91 are arcuate members as shown at 92.

In FIG. 1, the cable is shown not passing over the pulleys 42 and 42', but just over the upper pulleys at the top of the frame. By manipulating the grips to pull on the lines, force is applied to raise and lower the cage 60 carrying the weights. The user can exert pull on the lines directly away from the frame or in other directions since the pulley blocks 44 and 44' are hinged as described to accommodate the lines passing away from the pulleys in various directions. The same pulling force need not be exerted on both lines.

FIGS. 6 and 12 illustrate another manner of utilization of the invention. In these figures, the cable 70 is reeved over the pulleys in the blocks 41 and 41' so as to particularly accommodate a user in a position on the floor such as shown in FIG. 12. Either the hand grips at the ends of the cable can be used or the bar as shown in FIG. 9. The user can pull on the cables in various directions which are accommodated by the fact that the pulley blocks 41 and 41' have swivel mountings.

Figure 12A:
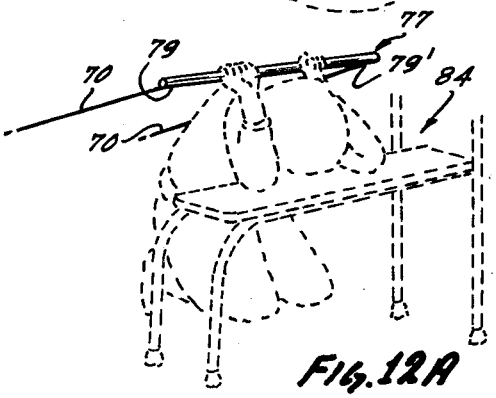
FIG. 12A is a view illustrating another manner of utilization of a form of the invention shown in FIG. 12.

FIG. 12A shows a variation of the manner of usage of FIG. 12 utilizing the rest or support stand 84 in the manner illustrated. The user is kneeling next to the stand with the bar 77 over his head in which position pulling movements can be exerted on the bar 77 along with upward and downward movements of it.

Figure 10:
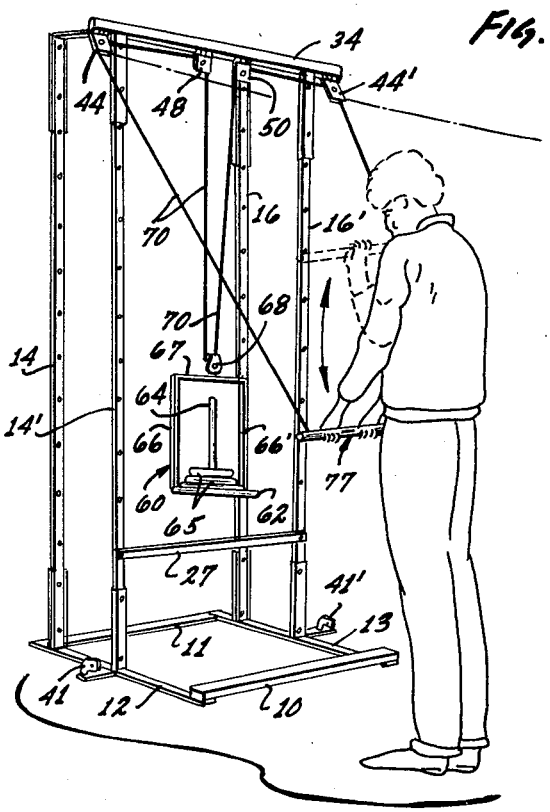
FIG. 10 is a perspective view similar to FIG. 1 showing a modified manner of utilization of the invention.
Figure 10A:
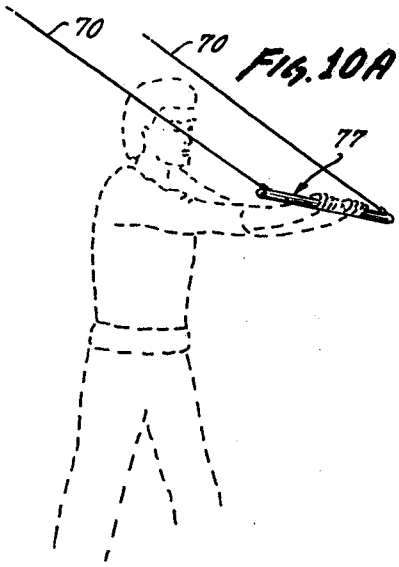
FIG. 10A is a detail view illustrating a variation in the utilization of the form of the invention of FIG. 10.

FIG. 10 shows another manner of utilization of the invention. In this case, the hand grips are unsnapped from the ends of the line or cable which are snapped to the eyes 79 and 79' at the ends of the hand bar 77. The cable arrangement is otherwise like that of FIG. 1. Various exercises can be performed as illustrated in FIG. 10 such as by pulling down or up on the bar or away from the stand or frame in various directions. FIG. 10A shows a variation of the exercises wherein the user stands between the stand or frame and the bar 77 allowing another range of exercises including ones that involve pushing the bar away from the stand.

Figure 11:
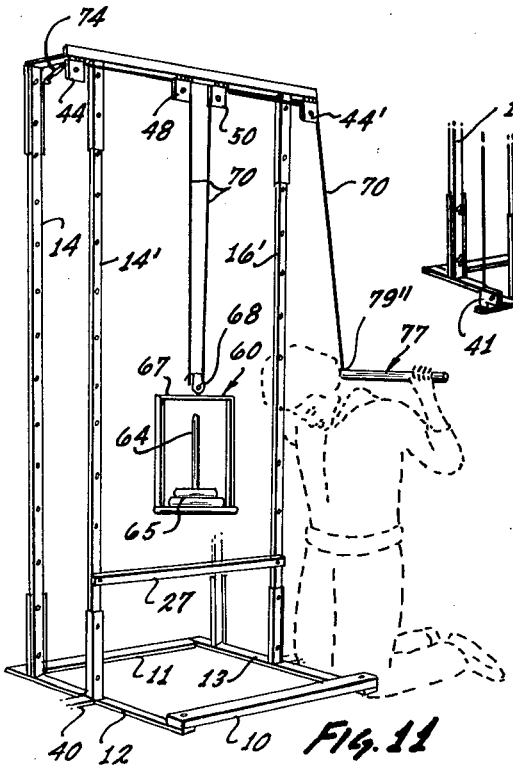
FIG. 11 is an illustrative view of another form of the invention or manner of utilization thereof.

FIG. 11 illustrates another manner of utilization of the invention. In this form of the invention, one of the snaps 74 is not connected to either a hand grip or the hand bar and is merely held against the pulley block 44 as shown. The cable 70 is attached to the center eye 79'' on the bar 77 and the user takes a position at one side of the frame or stand as shown in FIG. 11. The user could, of course, be either in the position shown facing the stand or facing away from it with his hands gripping opposite ends of the hand bar 77. In this way, the pull on one end of the cable 70 serves to lift the weight cage 60. Various types of exercising motions and maneuvers are possible in this situation.

The nature and versatility of the apparatus can be appreciated from the foregoing. Only a single assembly of weights is needed, the weights being carried by the cage 60. The user can assume many exercising positions either sitting, reclining, kneeling, standing up or otherwise or grasping the grips 72 and 72' or the hand bar 77. As described, the user can take positions in front of the stand or frame or at one side of it, or others.

The cage 60 can, of course, be moved from its position between the uprights and the user can, if desired, take a position directly between the uprights for purposes of exercising. In such a position, the user may manipulate a barbell assembly which normally can be supported by the J-hooks previously described.

From the foregoing, those skilled in the art will readily understand the nature and utilization of the invention and the manner in which it achieves and realizes the objects as set forth in the foregoing.

The foregoing disclosure is representative of preferred forms of the invention and is to be interpreted in an illustrative rather than a limiting sense, the invention to be accorded the full scope of the claims appended hereto.

What is claimed is:

1. An exercising device comprising:

a frame having a generally rectangular base, a pair of upstanding posts at each of opposite sides of said base and a generally rectangular upper member at the top of said posts, said posts being removably secured to said base and upper member;

cable guide means on said upper member between said pairs of posts and a movable weight cage having a pulley thereon below said cable guide means;

first pulley means hinged to said upper member, at opposite sides thereof, about a common transverse hinge axis;

second pulley means pivoted to said base, at opposite sides thereof substantially directly below said first pulley means and each being pivoted to said base about a generally vertical axis; and an elongated cable having its mid-portion trained over said pulley on said weight case with its ends extending upwardly through said cable guide means, then laterally in opposite directions around said first pulley means and having hand engaging means at its ends, said cable ends being selectively extendable from said first pulley means to a user adjacent said frame or from said first pulley means then around said second pulley means to said user said posts of each pair being provided with a plurality of aligned openings therethrough a bar extending through aligned openings and having a weight supporting portion at one end.

2. An exercising device as defined in claim 1 wherein said hand engaging means comprises an elongated grip bar having said cable removably secured thereto.

* * * * *